US006499637B1

(12) United States Patent
Zamarron

(10) Patent No.: US 6,499,637 B1
(45) Date of Patent: Dec. 31, 2002

(54) STOP ON BELT ATTACHED TOOL HOLDER

(76) Inventor: Salvador Zamarron, 12945 S. Western, Blue Island, IL (US) 60406

( * ) Notice: Subject to any disclaimer, the term of this patent is extended or adjusted under 35 U.S.C. 154(b) by 4 days.

(21) Appl. No.: 09/621,800

(22) Filed: Jul. 21, 2000

(51) Int. Cl.[7] ..... A45F 5/00

(52) U.S. Cl. ..... 224/251; 224/197; 224/242; 224/904

(58) Field of Search ..... 224/197, 678, 224/242, 251, 904

(56) References Cited

U.S. PATENT DOCUMENTS

| | | | | | |
|---|---|---|---|---|---|
| 2,664,231 | A | * | 12/1953 | La Mantia | 224/904 X |
| 3,343,735 | A | * | 9/1967 | Breeding et al. | 224/904 X |
| D221,123 | S | | 7/1971 | Nichols | |
| 4,321,755 | A | * | 3/1982 | Illgen | 224/904 X |
| 4,372,468 | A | | 2/1983 | Harvey | |
| 4,638,530 | A | | 1/1987 | Perry | |
| 4,790,461 | A | | 12/1988 | Stover | |
| 4,955,518 | A | * | 9/1990 | Parsons et al. | 224/247 |
| 5,232,136 | A | * | 8/1993 | Unger | 224/151 |
| 5,605,263 | A | * | 2/1997 | Pursley | 224/248 |
| 6,193,122 | B1 | * | 2/2001 | Buckley | 224/270 |

* cited by examiner

*Primary Examiner*—Stephen K. Cronin
(74) *Attorney, Agent, or Firm*—Don Moyer

(57) ABSTRACT

A belt attached tool holder has a base which in use is attached on a belt, has a collar which is attached to the base and which in use cradles a tool, and has a stop which is attached to the base and which in use holds the tool away from the base, wherein the stop can rotate upward when the collar rotates downward and can be energy absorbing.

6 Claims, 2 Drawing Sheets

STOP ON BELT ATTACHED TOOL HOLDER

BACKGROUND OF THE INVENTION

The stop limits swinging motion of a tool held in a belt attached tool holder.

Various improvements in belt attached tool holders shown in prior art—for example in U.S. Pat. No. Des. 221,123 by Nichols, U.S. Pat. No. 4,372,468 by Harvey, U.S. Pat. No. 4,638,530 by Perry, and U.S. Pat. No. 4,790,461 by Stover—do not suggest, nor does any combination suggest, the invention shown here.

SUMMARY OF THE INVENTION

The product comprises a base having a connector which in use connects the base to a belt worn by a person; comprises a collar, the collar being connected to the base; and comprises a stop, the stop being connected to the base with the stop protruding away from the base below the collar; wherein, in the most preferred embodiment, the collar rotates about a horizontal axis, the stop rotates about a second horizontal axis, and the stop is rotationally coupled to the collar so that when the collar rotates downward about the horizontal axis the stop is caused to rotate upward about the second horizontal axis.

DESCRIPTION OF THE PREFERRED EMBODIMENTS

Figure 1:
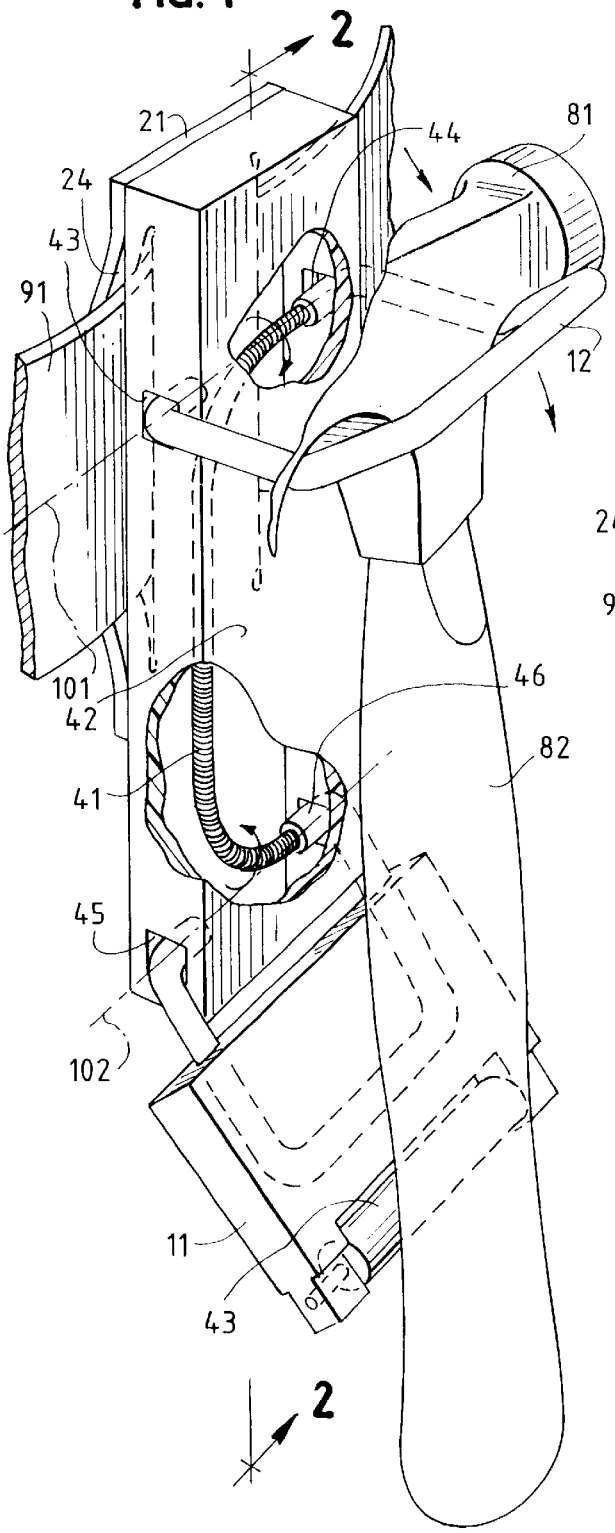
FIG. 1 depicts a stop which rotates to counter motion of a tool.

The product comprises a base 21 having a connector 24 which in use connects the base to a belt 91 worn by a person; comprises a collar 12, the collar being connected to the base; and comprises a stop 11, the stop being connected to the base with the stop protruding away from the base below the collar; wherein, in the most preferred embodiment, the collar rotates about a horizontal axis 101, the stop rotates about a second horizontal axis 102, and the stop is rotationally coupled 41 to the collar so that when the collar rotates downward about the horizontal axis the stop is caused to rotate upward about the second horizontal axis.

Figure 2:
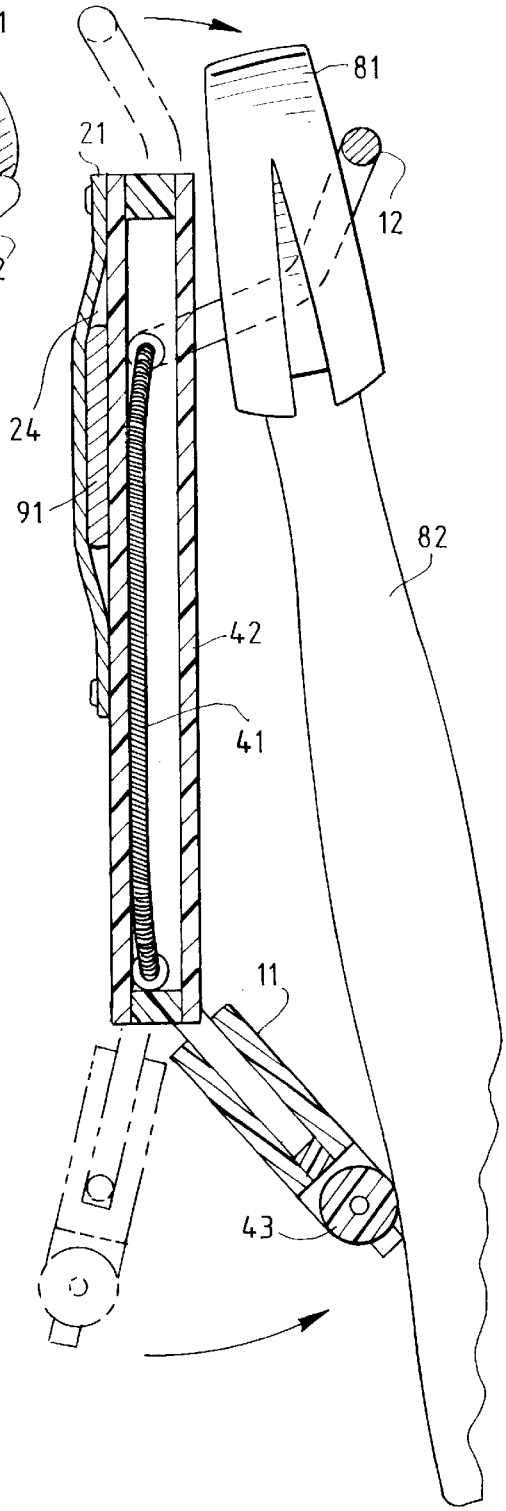
FIG. 2 is a view along line 2—2 in FIG. 1.

The most preferred form of the invention is depicted in FIG. 1 and FIG. 2. Principles of the invention are also embodied in forms depicted in FIG. 3 and FIG. 4.

Figure 3:
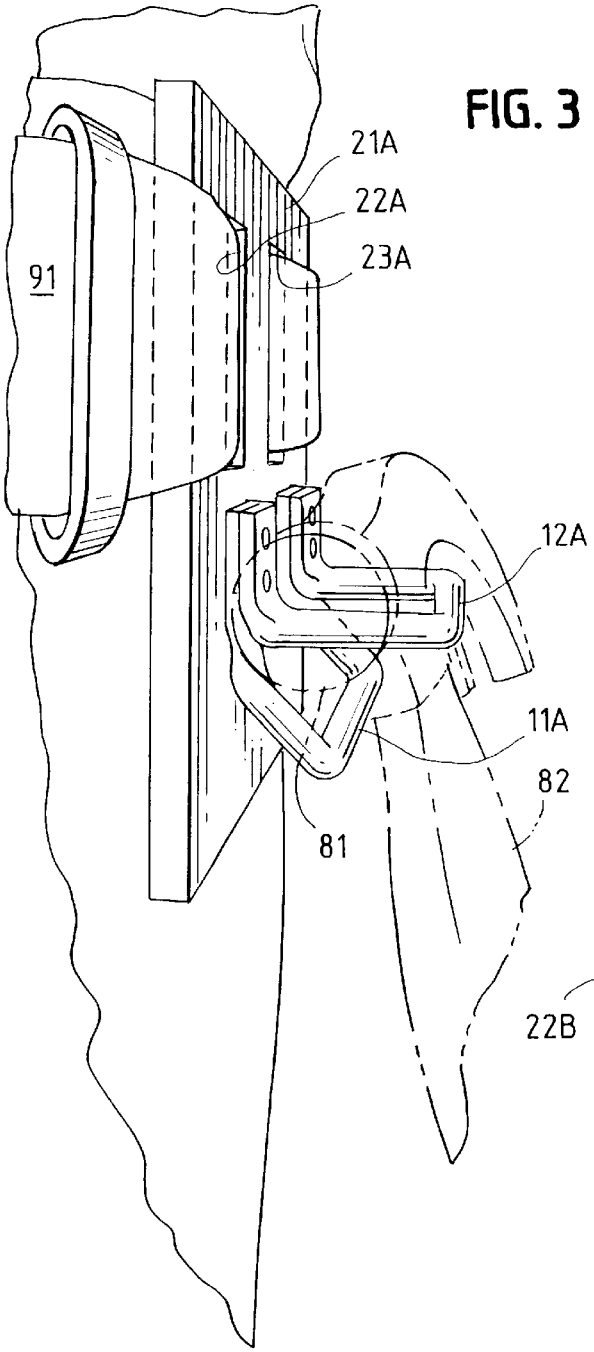
FIG. 3 depicts a bar form of a stop.

All forms of the tool holder have a base 21, 21A, 21B. In each form the base has a connector which in use connects the base to a belt 91 worn by a person. The connector can be a sheath 24 as depicted in FIG. 3, can be a pair of slots 22A, 23A and 22B, 23B through which the belt can be attached as depicted in FIG. 3, and can be various means known in the art such as clips, clasps, and hooks.

All forms of the invention have a collar 12, 12A, 12B. The handle of a tool—such as a hammer handle 82—fits through the collar with the tool head—such as a hammer head 81—being cradled by the collar. The collar can be connected to the base by various means known in the art such as by rivets as suggested in FIG. 1 and FIG. 2, and the collar can have various shapes to cradle tool heads.

The collar 12 can also be connected so that the collar rotates about a horizontal axis 101 which can be achieved by various means known in the art such as fitting collar portions aligned with the horizontal axis into bores 43, 44 in an enclosure 42 attached to the base as depicted in FIG. 1 and FIG. 2. In this case the collar can be biased to rotate upward by the weight of a rotationally coupled stop and by other means known in the art such as springs and torsion devices.

In all forms, swinging of the tool is limited by the stop 11 11A, 11B which is connected to the base and protrudes away from the base below the collar. In the form depicted in FIG. 3 the stop 11A is a bar. This stop can be connected to the base by various means known in the art such as a by being riveted to the base along with the collar, by direct attachment to the collar, and by attachment to the base independently of the collar.

Figure 4:
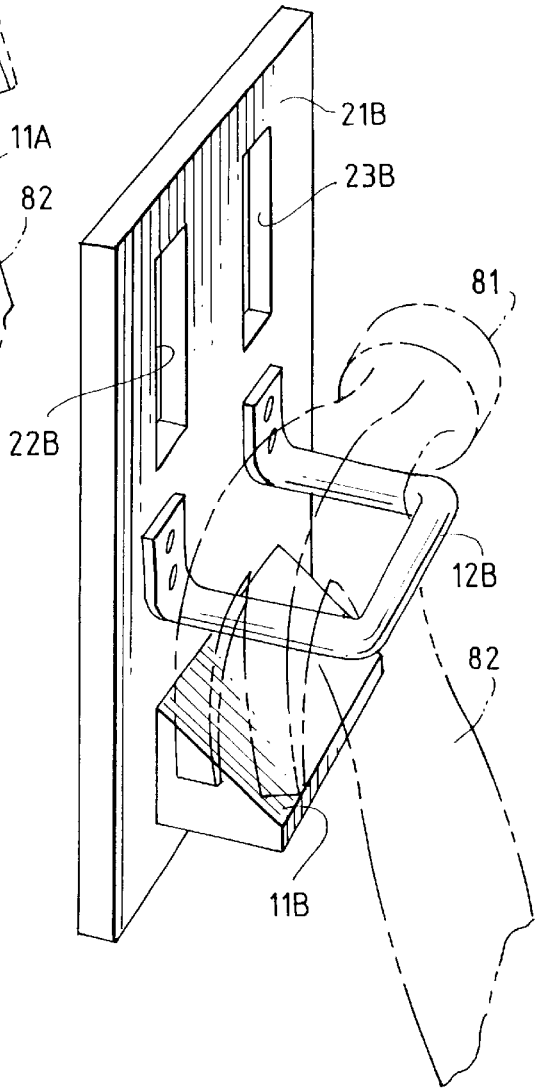
FIG. 4 shows a pad form of a stop.

The stop can be a pad 11B as depicted in FIG. 4. The pad can be made with energy absorbing material, such as Sorbothane (tm), which absorbs energy from the tool. The pad can be attached using various attaching devices such as rivets, stitching, and adhesive. The energy absorbing material used to make the pad can be encased in durable material such as leather.

The bar and the pad can have various shapes other than the shapes depicted. Energy absorbing material can also be attached to the bar 11A and to the rotating stop 11.

The stop can be connected to the base so that the stop rotates about a second horizontal axis 102—which can be achieved by various means known in the art such as fitting stop portions aligned with the second horizontal axis into stop bores 45, 46 in the enclosure 42 attached to the base as depicted in FIG. 1 and FIG. 2.

This stop is rotationally coupled to the collar by a wrapped cable 41 which is attached to the collar with the cable centerline on the horizontal axis and is attached to the stop with the cable center line on the second horizontal axis so that when the collar rotates downward the cable rotates about the cable center line and causes the stop to rotate upward about the second horizontal axis. Thus the weight of the hammer rotates the collar downward and the stop is caused to rotate upward to protrude away from the base below the collar.

While in FIG. 3 the wrapped cable 41 is shown constrained by an enclosure 42, various means for constraining all motions other than the rotation of the wrapped cable about its center line known in the art, such as an anchored sheath, can be used. Other means for rotationally coupling a collar and a stop can also be used.

A rolling sleeve 43 can be added to the stop 11 by various means known in the art such as the means depicted. The sleeve 43 can be made of an energy absorbing material. A rolling sleeve can also be added to the stop 11A.

Descriptions, drawings, and referenced elements illustrating principles of the invention do not limit the invention as other equivalent elements, element configurations, and operations comprehended by principles of the invention will be obvious hereafter to persons skilled in the a art.

The product claimed is:

1. A tool holder comprising:

a base, the base having a connector which in use connects the base to a belt worn by a person;

a collar, the collar being attached to the base so that the collar rotates about a horizontal axis; and a stop, the stop being attached to the base with the stop rotating about a second horizontal axis, the stop being rotationally coupled to the collar so that when the collar rotates downward about the horizontal axis the stop is caused to rotate upward about the second horizontal axis to protrude away from the base below the collar.

2. A tool holder comprising:

a base, the base having a connector which in use connects the base to a belt worn by a person;

a collar, the collar being attached to the base; and a stop, the stop being attached to the base, the stop protruding away from the base below the collar, the stop comprising a bar with energy absorbing material attached to the bar.

3. The device of claim 2 wherein the energy absorbing material attached to the bar is a rolling sleeve with energy absorbing material attached to the rolling sleeve.

4. The device of claim 2 wherein the collar rotates about a horizontal axis.

5. The device of claim 4 wherein the collar is biased to rotate upward about the horizontal axis.

6. The device of claim 4 wherein the stop rotates about a second horizontal axis and the stop is rotationally coupled to the collar so that when the collar rotates downward about the horizontal axis the stop is caused to rotate upward about the second horizontal axis to protrude away from the base below the collar.

* * * * *